US008276222B1

(12) United States Patent
Patrick

(10) Patent No.: US 8,276,222 B1
(45) **Date of Patent: *Oct. 2, 2012**

(54) PATIENT TRANSFER KIT

(75) Inventor: James E. Patrick, Plainfield, IL (US)

(73) Assignee: Smart Medical Technology, Inc., Darien, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/538,211

(22) Filed: Oct. 3, 2006

Related U.S. Application Data

(63) Continuation-in-part of application No. 11/036,413, filed on Jan. 14, 2005, now Pat. No. 7,114,204.

(51) Int. Cl.
*A61G 7/14* (2006.01)
*A61G 1/044* (2006.01)

(52) U.S. Cl. ..... 5/81.1 HS; 5/713

(58) Field of Classification Search ..... 5/706, 710, 5/713–715, 81.1 HS, 86.1, 932
See application file for complete search history.

(56) References Cited

U.S. PATENT DOCUMENTS

| | | | | |
|---|---|---|---|---|
| 1,970,502 | A | 8/1934 | Hamza | |
| 3,667,073 | A * | 6/1972 | Renfroe | 5/81.1 R |
| 3,705,429 | A | 12/1972 | Nail | |
| 3,739,407 | A | 6/1973 | Stiller et al. | |
| 3,760,899 | A | 9/1973 | Crossman et al. | |
| 3,948,344 | A | 4/1976 | Johnson et al. | |
| 3,959,835 | A | 6/1976 | Nos | |
| 4,090,897 | A | 5/1978 | Minick | |
| 4,272,856 | A | 6/1981 | Wegener et al. | |
| 4,528,704 | A | 7/1985 | Wegener et al. | |
| 4,584,989 | A * | 4/1986 | Stith | 600/18 |
| 4,686,719 | A | 8/1987 | Johnson et al. | |
| 4,837,872 | A | 6/1989 | DeMatteo et al. | |
| 4,860,395 | A | 8/1989 | Smith | |
| 4,944,060 | A | 7/1990 | Peery et al. | |
| 4,962,552 | A | 10/1990 | Hasty | |
| 5,044,030 | A * | 9/1991 | Balaton | 5/710 |
| 5,048,134 | A | 9/1991 | Dennill et al. | |
| 5,065,464 | A | 11/1991 | Blanchard et al. | |
| 5,067,189 | A | 11/1991 | Weedling et al. | |
| 5,090,077 | A * | 2/1992 | Caden et al. | 5/713 |
| 5,121,512 | A * | 6/1992 | Kaufmann | 5/713 |

(Continued)

OTHER PUBLICATIONS

Dionne, Michael, "Bariatric Ergonomics," Treating the Bariatric Patient, (Jan. 6, 2003), Gainesville, GA.

(Continued)

*Primary Examiner* — Michael Trettel
(74) *Attorney, Agent, or Firm* — Vedder Price P.C.

(57) ABSTRACT

A patient transfer kit including an inflatable mattress, alternatively with a rigid top board with a patient restraint system on which a patient can be placed, when patient immobilization is required. A portable cart is included with a chamber for storage of a plurality of mattresses. The cart also has a gas/air blower and power supply system for powering the blower. The power system includes provision for drawing power from line AC/DC, and has a rechargeable battery and charger for maintaining the battery by connecting the supply to the line AC/DC. The mattress has a perforated bottom surface for exit of air to provide an air cushion, and is constructed with a white top surface and a dark bottom surface for optimum recognition of contamination, and identification of the bottom surface which must be placed downward. The cart is coated with an antimicrobial substance to minimize the risk of contaminants.

8 Claims, 7 Drawing Sheets

U.S. PATENT DOCUMENTS

| | | | | |
|---|---|---|---|---|
| 5,235,713 | A | | 8/1993 | Guthrie et al. |
| 5,487,196 | A | | 1/1996 | Wilkinson et al. |
| 5,561,873 | A | | 10/1996 | Weedling |
| 5,699,570 | A | * | 12/1997 | Wilkinson et al. ..... 5/713 |
| 5,742,958 | A | | 4/1998 | Solazzo |
| 5,860,174 | A | | 1/1999 | Failor |
| 5,960,497 | A | | 10/1999 | Catellino et al. |
| 5,996,150 | A | | 12/1999 | Blevins et al. |
| 6,021,533 | A | | 2/2000 | Ellis et al. |
| 6,073,284 | A | | 6/2000 | Borders |
| 6,073,291 | A | | 6/2000 | Davis |
| 6,119,292 | A | * | 9/2000 | Haas ..... 5/715 |
| 6,295,675 | B1 | | 10/2001 | Ellis et al. |
| 6,427,270 | B1 | | 8/2002 | Blevins et al. |
| 6,467,106 | B1 | | 10/2002 | Heimbrock |
| 6,467,113 | B2 | | 10/2002 | Ellis et al. |
| 6,484,334 | B1 | | 11/2002 | Borders et al. |
| 6,598,902 | B2 | | 7/2003 | Keshavaraj |
| 7,107,641 | B2 | * | 9/2006 | Davis ..... 5/710 |
| 7,114,204 | B2 | * | 10/2006 | Patrick ..... 5/81.1 R |
| 2002/0029423 | A1 | | 3/2002 | Ellis et al. |
| 2002/0166168 | A1 | | 11/2002 | Weedling et al. |
| 2003/0019042 | A1 | | 1/2003 | Ellis et al. |
| 2003/0070226 | A1 | | 4/2003 | Heimbrock |
| 2003/0159212 | A1 | | 8/2003 | Patrick |

OTHER PUBLICATIONS

Hovermatt, A D.T. Davis Enterprise, "Patient Handling Technologies, Specializing in Patient Handling & Workers Comp. Reduction Programs," (Oct. 1, 2000), Allentown, PA.

Hovermatt, "A Cushion of Air That Makes Transferring our Patients a Breeze." (Date Unknown).

Plexus Medical, "Low Air Loss/APM Therapy System Operating Instructions," (Feb. 2002).

* cited by examiner

PATIENT TRANSFER KIT

RELATED APPLICATIONS

This application is a continuation-in-part of U.S. patent application Ser. No. 11/036,413 filed Jan. 15, 2005, now U.S. Pat. No. 7,114,204.

FIELD OF THE INVENTION

The present invention relates generally to apparatus for transferring bed patients, and more particularly to a system including a bed with an inflatable mattress for moving a patient on a cushion of air, wherein the bed has integrated thereon an assembly including a gas/air supply for inflating the mattress, and an air mattress storage container.

BACKGROUND OF THE INVENTION

Non-ambulatory patients who must be supported and moved in a patient facility such as a hospital or a nursing home present substantial challenges when a course of treatment for such patients calls for movement from one location to another. A patient, for example, may need to be moved from a hospital bed, which must remain in the patient's room, to a stretcher and then from the stretcher to a treatment location such as a surgical table in an operating room. Following treatment the reverse patient handling sequence must occur; i.e., the patient must be moved from the surgical table, which remains in the operating room, to a stretcher which travels to the patient's hospital room, and then from the stretcher back onto the bed in the hospital room.

In a very large percentage of such occurrences the patient must be handled in a fashion which requires only a minimum of movement of the patient with respect to a supporting surface. In the case of a patient being returned to a hospital room following surgery, for example, the patient's body may not be able to withstand the stresses and strains of being lifted from a stretcher to the bed when one or even several hospital personnel combine their efforts to make such a transfer.

The same challenge of moving a patient with minimum handling exists in non-surgical settings as well. The bariatric patient is a prime and very common example. When such a patient is morbidly obese, transferring presents difficulties for both the patient and the care facility staff. While no exact definition of morbid obesity is universally recognized, many hospitals and other treatment facilities consider a person who weighs about 350 pounds or more to fall within that definition.

Movement of a morbidly obese person often requires the hospital staff to physically lift and/or slide the patient from an at rest position on a hospital bed to an at rest position on a stretcher a total of four times to complete a single treatment cycle, such as surgery. The staff must perform the task of lifting and/or sliding such a patient because in nearly all instances the patient, due to the physical condition of obesity and/or illness, simply cannot personally do the task. The manipulation of such a person requires a plurality of hospital staff since such manipulation is impossible to perform by a single person such as a floor nurse assigned to the patient's room. As a consequence, such transfers must be planned in advance for a specific time and a number of hospital staff must be notified and arrange their schedules so that all staff will be available at the same time. As is well known, many hospital staff are females and many of these persons are rather slight of stature. As a result, a half dozen or more such persons may need to be assembled. Instances have been known in which a morbidly obese patient has required twelve persons to effect the transfer. Gathering together such a large number of people four times at often uncertain intervals to provide but a single cycle of treatment raises obvious logistical problems and, in addition, erodes the quality of care the facility can render by reason of the application of such a large number of personnel to deal with but a single patient treatment episode.

A further drawback to such a patient handling system as above described is that, even with the best intentioned and caring of staff, the patient very often suffers substantial discomfort. The simple act of sliding a patient over a flat surface can be very painful to a patient who has had surgical incisions which are far from healed, for example.

An attempt has been made to overcome the above described problems by the use of an air mattress onto which the patient is placed while in his bed and which is then placed onto a wheeler. A problem common to all such devices is that invariably the air mattress has the general characteristic of a balloon, in the sense that when one area is indented another remote area will bulge, thus creating an unstable condition. If for example a stretcher carrying an obese person makes a sharp turn during a trip to or from a treatment location, such an obese person will tend to roll toward the outside of the turn due to the instability of such a conventional mattress. The more the patient rolls, the more the mattress portion toward which the rolling movement occurs will depress, and the greater will be the expansion of the mattress on the other side of the patient. In effect, the conventional mattress reinforces the undesirable rolling movement and is unstable. Since much of the time the patient is incapable of stopping the rolling action by himself, the patient may roll off the stretcher onto the floor with disastrous consequences. Indeed, even in the instance of a patient who is capable of moving himself to some degree about his longitudinal body axis the same disastrous result may occur because the displacement of air from one edge portion of the mattress to the opposite edge portion creates in effect a tipping cradle. Only if the patient lies perfectly flat and perfectly still on the stretcher, and no roadway depressions or blocking objects, such as excess hospital beds stored in a hallway, are encountered can the probabilities of an accident be lessened.

Another problem with prior art methods of moving patients using an air cushion is the complexity of the procedure. The air mattress must first be positioned under the patient. Then an air pump must be transported to the bed area and connected to the mattress. The mattress is then inflated and the patient moved. The same process is repeated each time the patient needs to be transferred from one bed/stretcher/table to another.

A still further problem with prior art apparatus is control of contamination. Often, a tedious cleaning protocol follows after such use to avoid cross-contamination. Cleaning is particularly difficult because contaminant particles can penetrate into the mat material, and when the mat is inflated, the pressure can force the particles out and into the air. The high cost of prior art air cushions requires their re-use.

SUMMARY OF THE INVENTION

Briefly, a preferred embodiment of the present invention includes a patient transfer apparatus including an inflatable mattress, alternatively with a rigid top board with a patient restraint system on which a patient can be placed when patient immobilization is required. A portable cart is included with a chamber for storage of a plurality of mattresses. The cart also has a gas/air blower and power supply system for empowering the blower. The power system includes provision for drawing power from line AC/DC, and has a rechargeable battery and charger for maintaining the battery by connecting the supply to the line AC/DC. The mattress has a perforated bottom surface for exit of air to provide an air cushion, and is constructed with a white top surface and a dark bottom surface for optimum recognition of contamination, and identification of the bottom surface which must be placed downward. The cart is coated with an antimicrobial substance to minimize the risk of contaminants.

IN THE DRAWING

DESCRIPTION THE PREFERRED EMBODIMENTS

Figure 1:
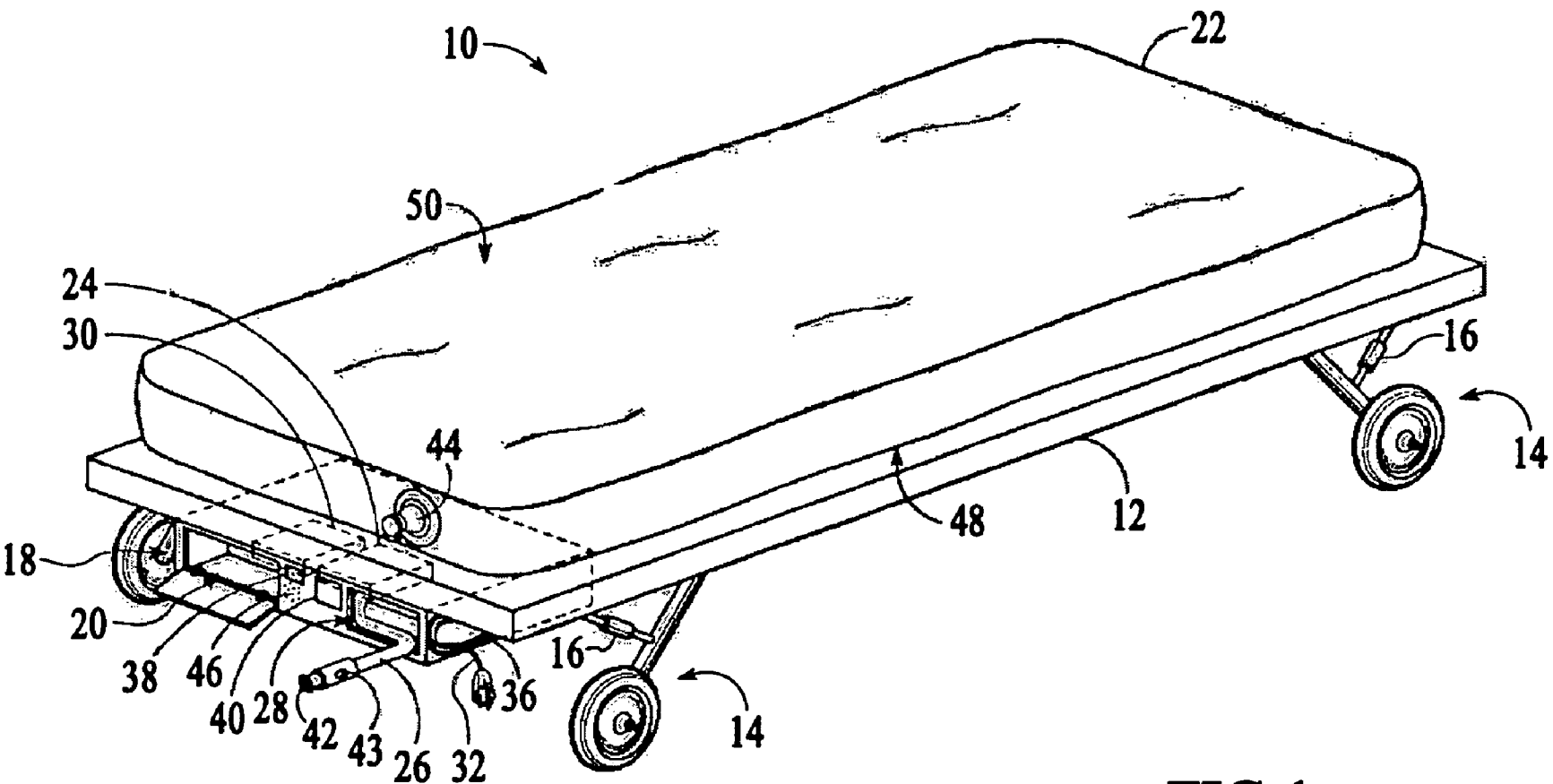
FIG. 1 illustrates an integrated patient transfer system according to the present invention as applied to a stretcher.

An embodiment of the system 10 of the present invention is shown in FIG. 1 as applied to a stretcher 12. The stretcher 12 can be of any type, such as used in a hospital or an ambulance, and can have fixed height legs 14 or adjustable height as indicated symbolically by adjusters 16. According to the system of the present invention, a patient bed illustrated as a stretcher 12 in FIG. 1 is assembled with an air mattress air supply system 18 attached. The term "air" as used in the present disclosure is meant to refer to air or any other gas that can be used to inflate an inflatable mattress. "Air mattress" therefore refers to a mattress that can be inflated with any such gas. Although the bed is illustrated as a stretcher, the present invention includes any type of bed/surface for supporting a patient, and will be referred to as a bed apparatus including any form of patient support, apparatus, such as a stretcher or hospital bed, etc. The supply system 18 has a compartment 20 for storage of one or more air mattresses such as air mattress 22 for placement on a bed/stretcher 12. The supply system 18 has included a gas/air blower 24, a gas/air hose 26 and apparatus for storing the hose 28. A power supply 30 is included, having a rechargeable battery and recharging supply. A power cord 32 and cord storage 36 is provided. The cord 32 can be plugged into an AC outlet for running the blower, and/or simply for charging the battery. With the battery charged, the blower can be operated without the need to plug the cord into an outlet. The supply 30 has an on-off switch 38, and alternatively a display/indicator 40 for showing the degree of charge on the supply battery. The hose 26 has a connector 42 on a distal end for connection to a receptacle 44 on the air mattress 22. As a further embodiment, an alternative power switch 43 is provided near the connector 42. As an alternate embodiment, various portions of the system 10 may be coated in part or totally with an antimicrobial coating, indicated symbolically with dots in FIG. 1 on a portion 46.

The air mattress 22 is constructed with small holes in the bottom surface 48 to allow gas to exit from inside the mattress 22 so as to create an air cushion for levitating the air mattress. As an alternate embodiment, the bottom surface with the holes is marked to indicate that it is to be placed downward. The top surface 50 is preferably a very light color, more preferably white to more easily observe contamination. The purpose of the very light top surface is to allow operating personnel to more easily identify contamination on the top surface. The mattress may be constructed with a white top surface and a dark bottom surface for optimum recognition of contamination, and identification of the bottom surface which must be placed downward. A substantial portion of the air mattress 22 (approximately 90%) is preferably constructed of nylon, and as a result is less expensive to fabricate than prior art air mattresses. The low cost, disposable air mattress of the present invention is a major improvement in sanitation for an inflatable air mattress, since contaminant particles can become embedded in the air mattress material which makes cleaning difficult. This is a particular problem because when an air mattress is inflated, the gas pressure forces contaminants from the material, making them air borne. The air mattress seams are sonically welded together, which reduces artifacts in x-rays.

The inflatable air mattress 22 can be positioned on a firm surface such as the slab 51 illustrated in FIG. 1, or alternatively the air mattress 22 can be placed either on top of or under a non-inflatable mattress. These alternative positions are illustrated more clearly in a planar view, as shown and discussed in reference to FIG. 7.

Figure 2:
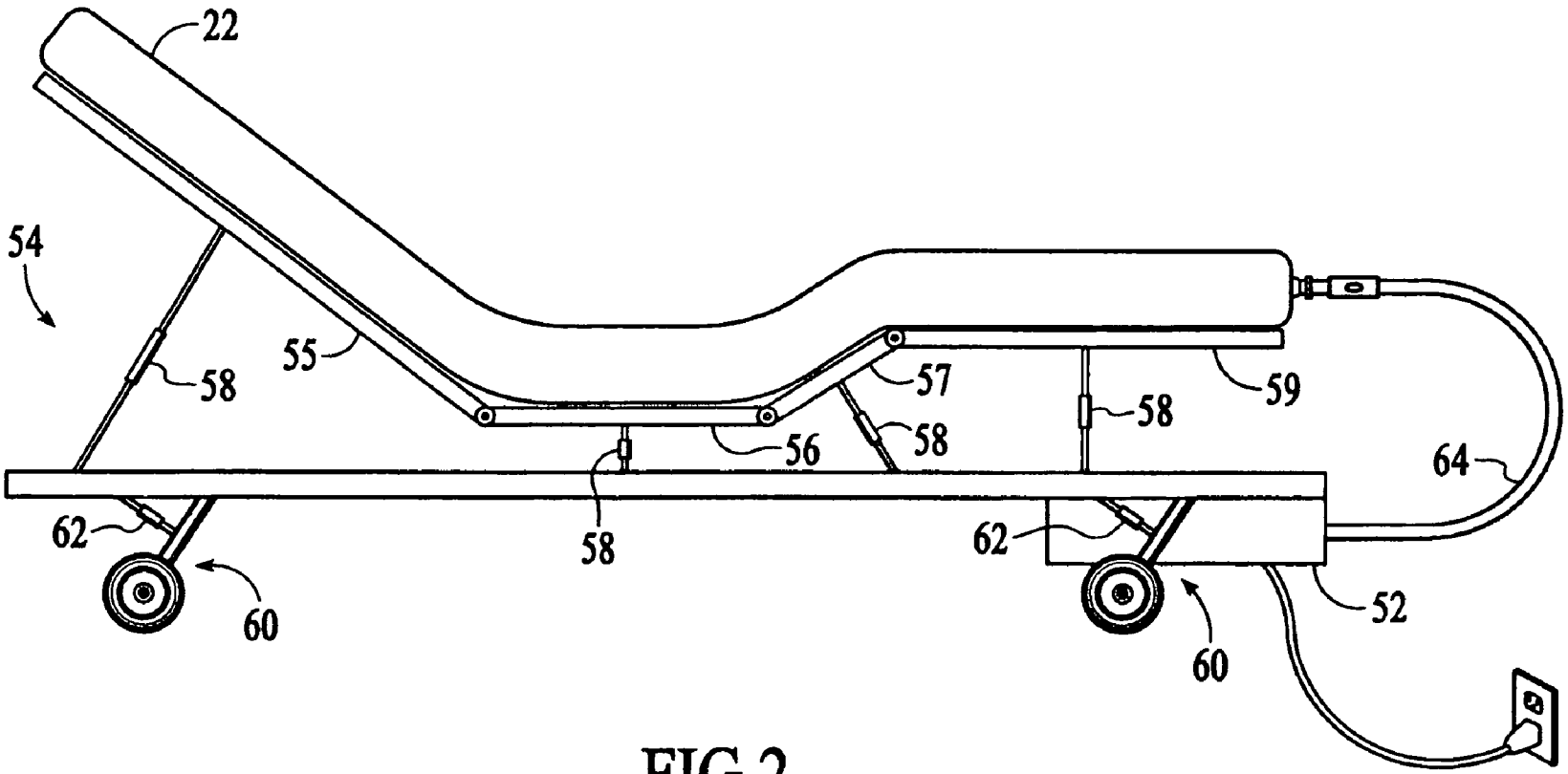
FIG. 2 illustrates an integrated patient transfer system according to the present invention as applied to a hospital bed.

FIG. 2 illustrates the integration of a supply system 52 on an adjustable hospital bed 54. The supply system 52 has the features of the supply system 18 that is integrated on the stretcher of FIG. 1. The bed 54 and stretcher 12 are only symbolically illustrated. Those skilled in the art will know how to construct a stretcher and adjustable hospital bed. The present invention includes the combination of any stretcher or bed with a supply system attached/integrated such as supply 18 or 52. Planar items 55, 56, 57, 59 and adjusters 58 are symbolically shown to indicate an adjustable patient surface, and optional adjustable legs are indicated symbolically by legs 60 and adjusters 62. A hose 64 is shown connected to the air mattress 22. The air mattress 22 shown in FIG. 2 is shown placed on firm planar elements/items 55-59. The mattress 22 of FIG. 2 can also be placed on top of or under a non-inflatable mattress in a similar way as that described in reference to FIG. 1, and shown and described in reference to FIG. 7.

Figure 3:
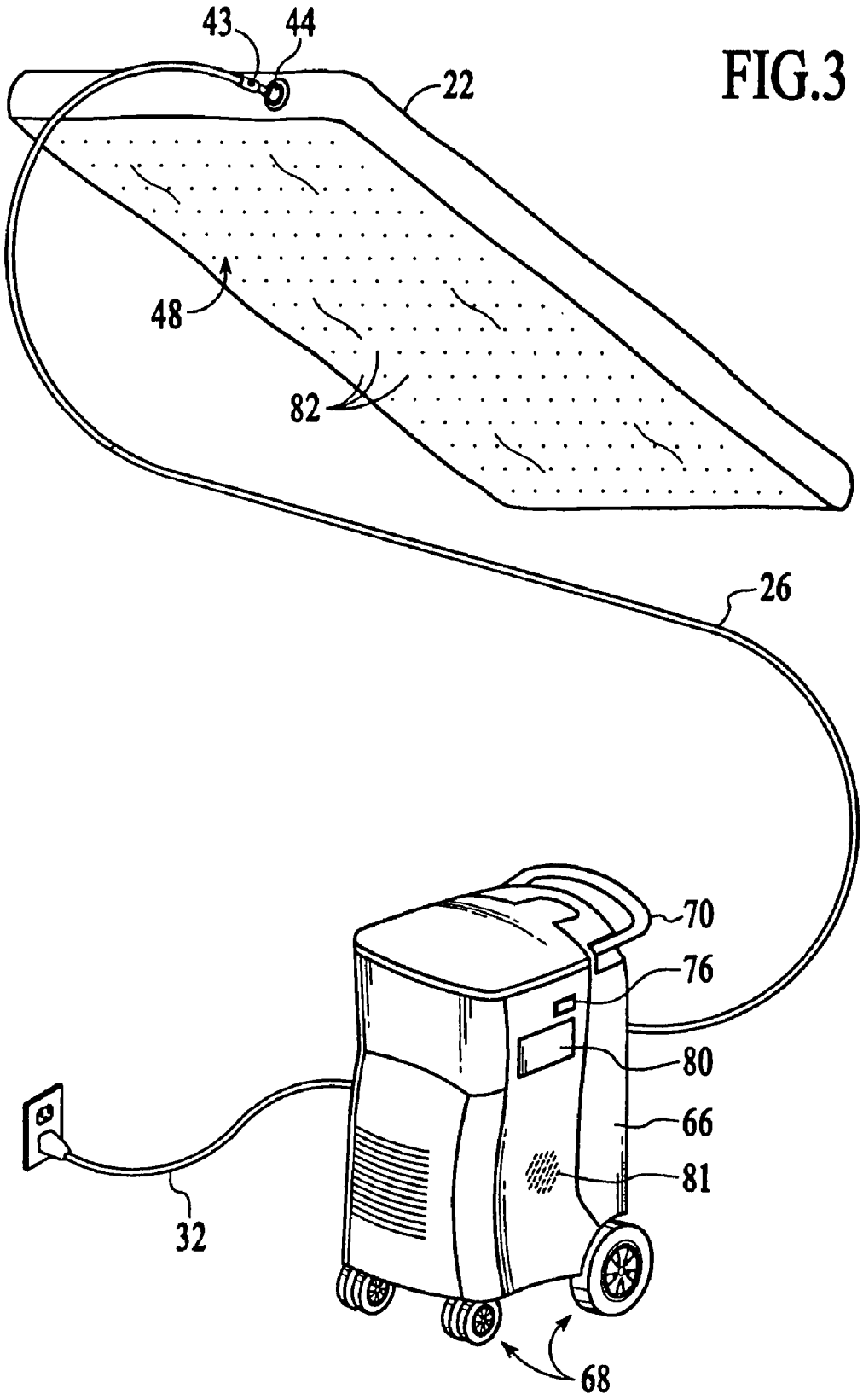
FIG. 3 illustrates an air cushion and supply cart according to the present invention.

An alternate embodiment of the present invention is illustrated in FIG. 3 for use in applying the system to existing beds. In this embodiment, a portable supply cart 66 is provided for supplying air to an air mattress 22. The cart 66 has wheels 68 and a handle 70 for convenient portability. The cart 66 also has features similar to those described in reference to the supply 18 of FIG. 1, including a storage compartment for storage of one or more air mattresses 22, a rechargeable power supply, a hose 26 and power cord 32, one or more on-off switches located either at 76 or 43 or at both positions, and alternatively a display 80 for showing the degree of charge on a rechargeable battery cart inside and outside included in the cart 66. As an alternate embodiment, the cart 66 can have an antimicrobial coating 81 on part or all of the cart inside and outside surfaces. An antimicrobial surface in the mat storage chamber 86 (FIG. 4) helps maintain the sanitary condition of a mat or mats stored therein prior to their use on a bed. The view of the air mattress 22 of FIG. 3 allows illustration of the bottom surface 48 and the holes for exit of gas/air, noted as items 82.

Figure 4:
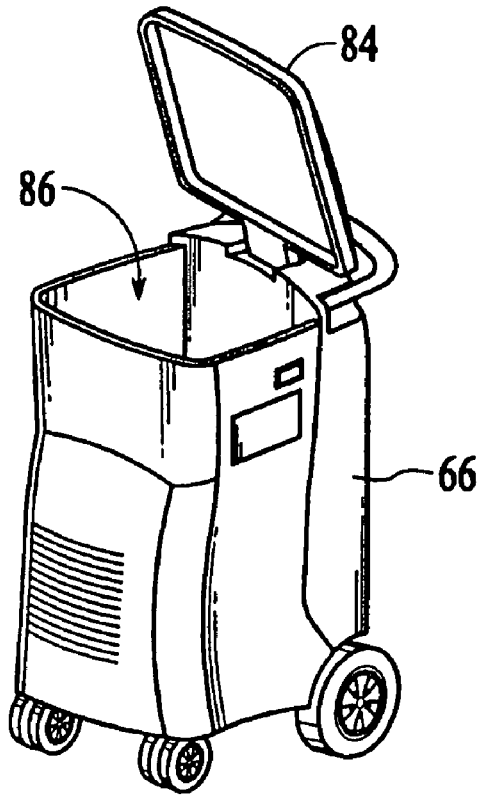
FIG. 4 illustrates an air cushion storage section of the cart of FIG. 3.

FIG. 4 shows a view of the cart 66 with a lid 84 open to show enclosure/compartment 86 for storing one or more air mattresses 22.

Figure 5:
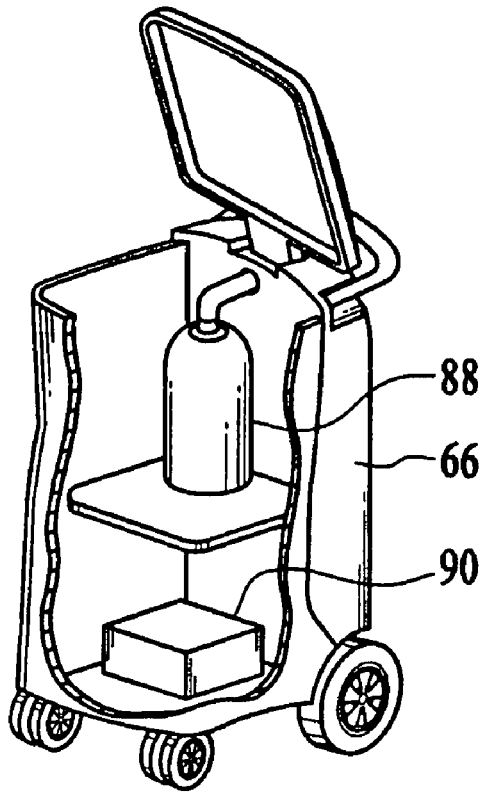
FIG. 5 is a sectional view of the cart of FIG. 3 for illustrating an air blower and power supply.

FIG. 5 is a sectional view of the cart 66 for showing a gas/air blower 88 and a power supply 90 as part of the cart 66. The blower 88 and supply 90 have the same functions as the blower 24 and supply 30 of FIG. 1.

Figure 6:
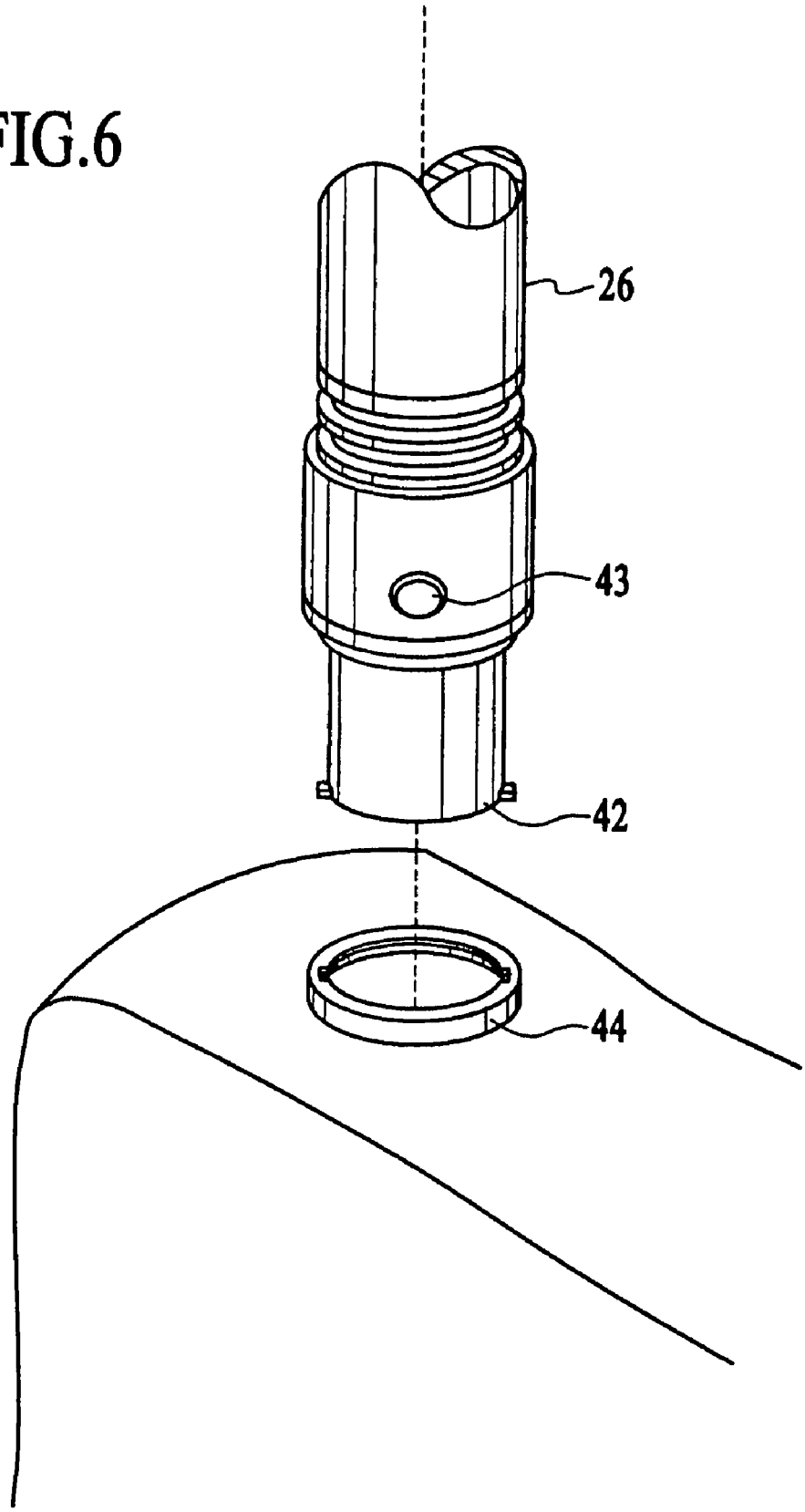
FIG. 6 illustrates interconnecting apparatus for attaching an air supply hose to the mat.

FIG. 6 provides a more detailed view of the receptacle 44 and connector 42 introduced in reference to FIG. 1. This connector and receptacle combination is an improvement over prior art apparatus used to connect to inflatable mattresses for providing an air cushion for moving patients. The prior art connections are made with hook and loop material that can harbor contamination. The nonporous surface of the material of the apparatus of FIG. 6 is more sanitary since it can be easily cleaned.

Figure 7:
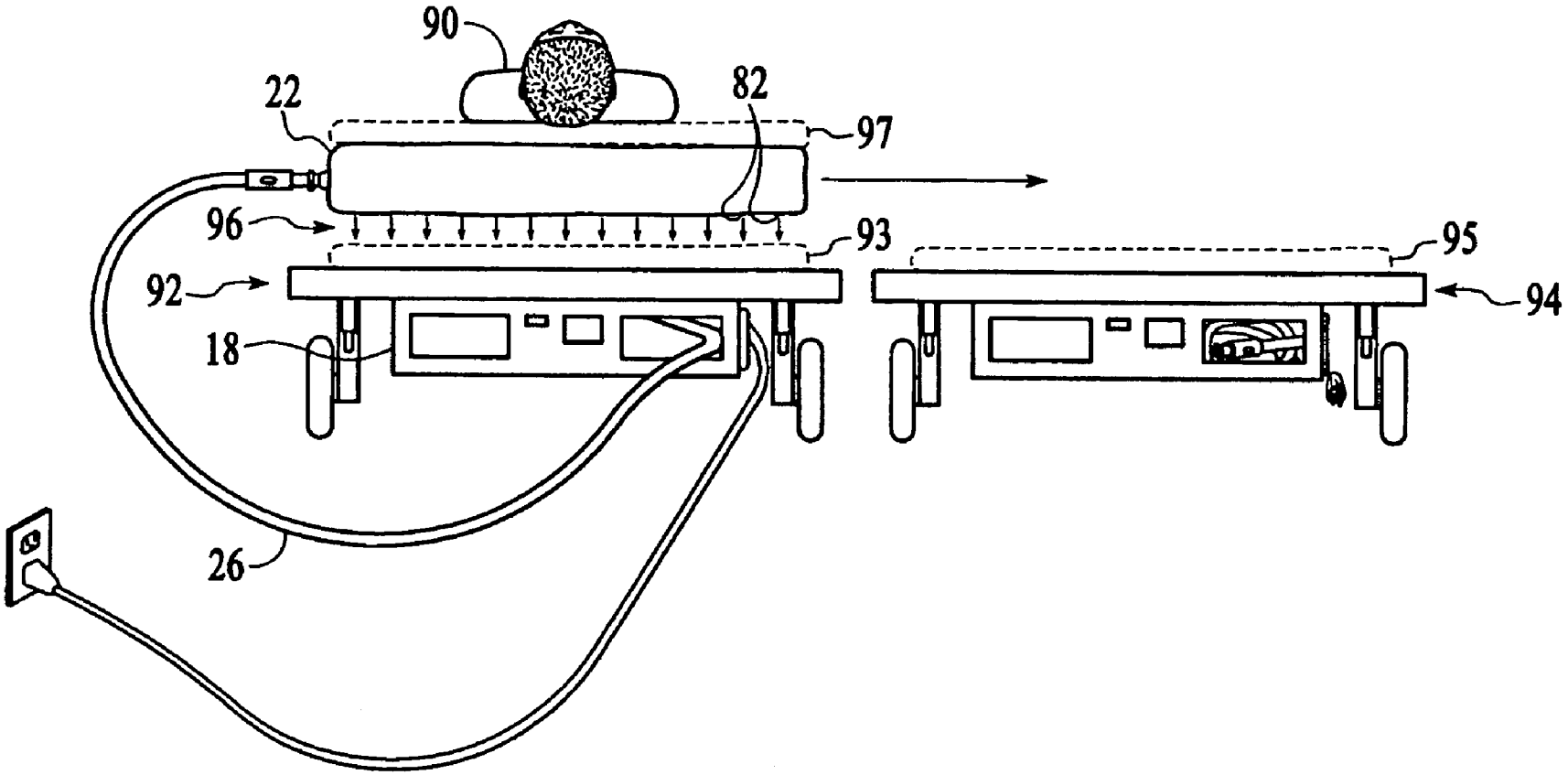
FIG. 7 illustrates patient movement between beds.

FIG. 7 illustrates a system of the present invention in operation. A patient 90 is on a first bed apparatus 92, and is to be moved onto an adjacent second bed apparatus 94. The patient 90 has been placed on an inflatable mattress 22 for providing an air cushion 96, and the supply system 18 has the hose 26 connected to the air mattress 22 and is supplying a gas, a portion of which is forced out exit holes 82, causing the air mattress 22 to float on a cushion of air/gas 96. An attendant can at this stage, move the air mattress 22 with patient over onto the bed 94. The planar view of FIG. 7 is also used in the present disclosure to illustrate placing the air mattress either above or below a non-inflatable mattress. Dashed outline 93 illustrates a non-inflatable mattress on which air mattress 22 is placed. A similar non-inflatable mattress 95 can also be placed on bed 94. Alternatively, the air mattress 22 can be placed under a non-inflatable mattress 97 upon which the patient 90 is placed. Any combination of inflatable air mattresses as described herein with non-inflatable mattresses on any of the various beds described in the present disclosure are included in the present invention.

Figure 8:
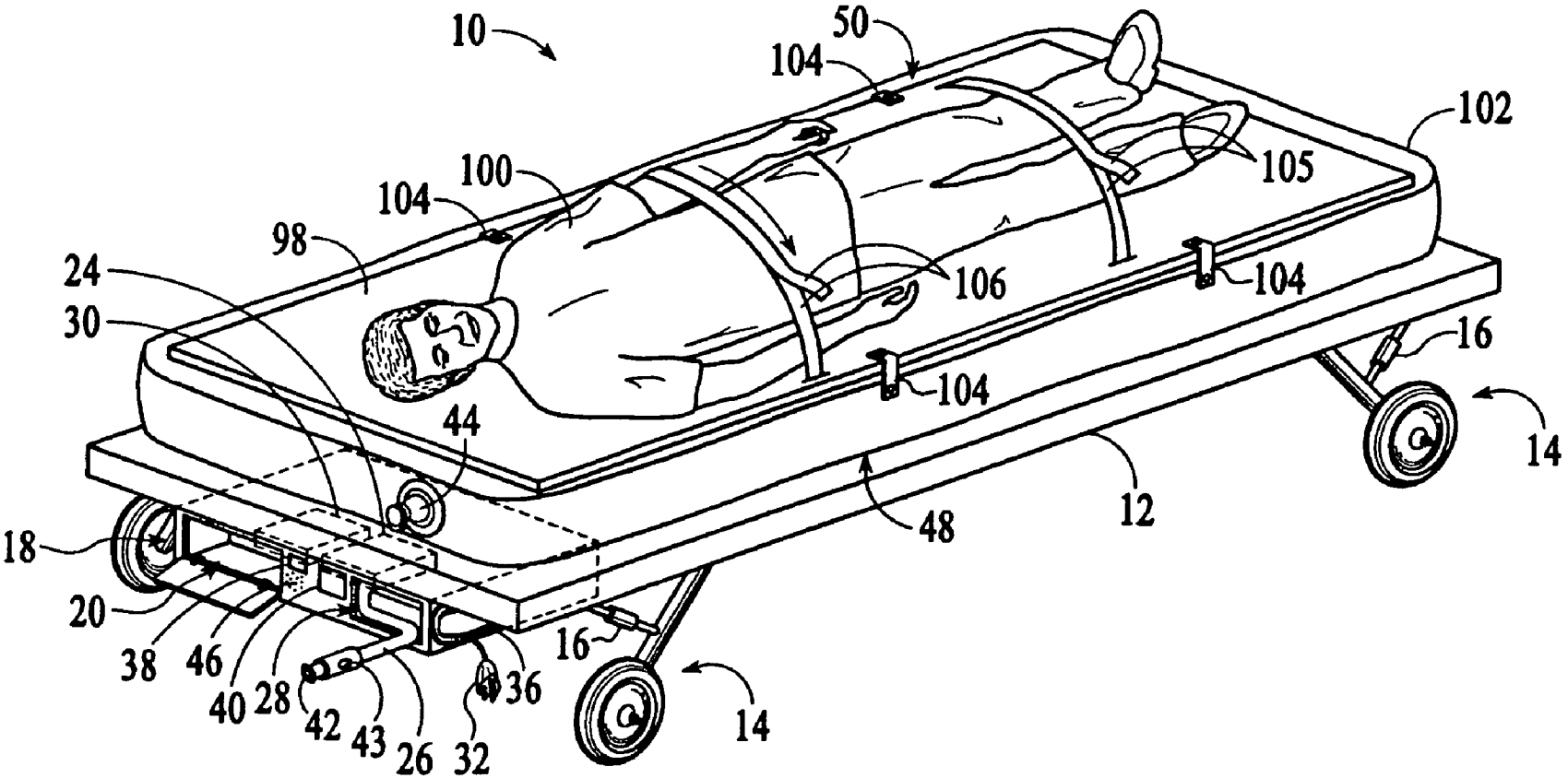
FIG. 8 illustrates a board with the inflatable mattress.

FIG. 8 shows a bed with the inflatable mattress and supply system similar to that displayed in FIG. 1, except for the addition of a board 98 for stabilization of a patient 100. The board 98 is shown attached to the inflatable air mattress 102 with fasteners 104. Other methods for attaching/retaining the board 98 to the mattress 102 will be apparent to those skilled in the art, and these are also included in the spirit of the present invention. One example of another method of retaining the board would be to insert it in a pocket attached to or integral with the mattress 102. For further stabilization of the patient 100, straps 105 and 106 may be included, attached to the board 98 as shown, or to the mattress 102. A board as described with the attachment can be used whenever the inflatable mattress is used, in all of the applications as described in the present disclosure. The mattress 102 may be placed directly on the firm surface of the stretcher 12, or on a similar surface of a hospital bed, or it can be placed over a non-inflatable mattress as described in reference to FIG. 7.

The above embodiments of the present invention have been given as examples, illustrative of the principles of the present invention. Variations of the method and apparatus will be apparent to those skilled in the art upon reading the present disclosure. These variations are to be included in the spirit of the present invention.

What is claimed is:

1. A system for patient management comprising: an inflatable mattress with a plurality of air exit holes on a bottom portion for providing an air cushion, said mattress including a top portion having a color of white for ease of observing contamination; and an integrated assembly of components including a patient support apparatus upon which to place said mattress the patient support apparatus including; a storage compartment for storing at least one mattress; and an inflation apparatus selectively connectable to the mattress for inflating the mattress and, optionally, selectively connectable to the patient support apparatus.

2. A system as recited in claim 1 wherein said inflation apparatus includes an air blower; and a power supply apparatus for supplying AC/DC power to said air blower, said power supply apparatus including a rechargeable battery and a battery charger.

3. A system as recited in claim 1 wherein said patient support apparatus is a stretcher.

4. A system as recited in claim 1 wherein said patient support apparatus is an adjustable hospital bed.

5. A system as recited in claim 1 wherein said mattress includes indicia to indicate that said bottom portion is correctly oriented downward.

6. A system as recited in claim 1 wherein a portion of said patient support apparatus is coated with an antimicrobial coating.

7. A system as recited in claim 1 wherein said inflation apparatus includes an air blower and a hose connected at a proximal end to the airblower and at a distal end to the mattress, the hose further including a power supply on-off switch disposed proximal to a distal end of said hose for selectively activating the air blower.

8. A system as recited in claim 2 wherein said power supply apparatus further includes a display for indicating a degree of charge of said battery.

* * * * *